US008500207B2

(12) United States Patent
Nickels et al.

(10) Patent No.: US 8,500,207 B2
(45) Date of Patent: Aug. 6, 2013

(54) ROCK CLAW FOR DEMOLITION HAMMER

(75) Inventors: James G. Nickels, McGregor, TX (US); Tommie L Craven, Belton, TX (US); Lauritz P. Pillers, McGregor, TX (US)

(73) Assignee: Caterpillar Inc., Peoria, IL (US)

( * ) Notice: Subject to any disclaimer, the term of this patent is extended or adjusted under 35 U.S.C. 154(b) by 302 days.

(21) Appl. No.: 12/967,110

(22) Filed: Dec. 14, 2010

(65) Prior Publication Data

US 2012/0145422 A1 Jun. 14, 2012

(51) Int. Cl.
*E21C 31/12* (2006.01)

(52) U.S. Cl.
USPC ..... 299/69; 299/100; 173/185

(58) Field of Classification Search
USPC ..... 299/104, 105, 69, 100, 64, 67, 37.4, 299/37.5; 173/46, 162.1, 210, 185, 128, 171
See application file for complete search history.

(56) References Cited

U.S. PATENT DOCUMENTS

| | | | | |
|---|---|---|---|---|
| 1,804,360 | A | 5/1931 | Magee | |
| 2,122,686 | A | 7/1938 | Gaty | |
| 3,889,762 | A * | 6/1975 | Sumner | 173/210 |
| 4,034,816 | A | 7/1977 | Lutich et al. | |
| 4,133,394 | A * | 1/1979 | Wohlwend | 173/210 |
| 4,182,421 | A | 1/1980 | Zubarev et al. | |
| 4,602,821 | A | 7/1986 | Schaeff | |
| 4,759,412 | A | 7/1988 | Brazell, II | |
| 5,060,734 | A * | 10/1991 | Anderson et al. | 173/128 |
| 5,363,835 | A | 11/1994 | Robson | |
| 5,944,120 | A * | 8/1999 | Barden | 173/212 |
| 6,095,257 | A | 8/2000 | Lee | |
| 6,328,116 | B1 * | 12/2001 | Hurskainen et al. | 173/128 |
| D458,614 | S | 6/2002 | Esterhuyse et al. | |
| 6,964,362 | B2 * | 11/2005 | Shkolnikov et al. | 227/130 |
| 7,124,838 | B2 | 10/2006 | Stewart et al. | |

FOREIGN PATENT DOCUMENTS

| | | |
|---|---|---|
| AU | 559417 | 3/1987 |
| DE | 29503157 | 4/1995 |
| GB | 2026370 | 2/1980 |
| WO | 2006033504 | 3/2006 |

OTHER PUBLICATIONS

Author Unknown, Demolition Attachments, Case Construction: pp. 2-19, Sep. 16, 2009.*

Caterpillar: "Hydralic Hammers—H45 through H180 s", Dec. 31, 2004, XP002671826, Retrieved from the Internet: URL:http://www.borusanmakina.com/BorusanMakina/Machines/pdf/Caterpillar%30Kiricilar.pdf, retrieved on Mar. 16, 2012,, p. 5.

* cited by examiner

*Primary Examiner* — David Bagnell
*Assistant Examiner* — Michael Goodwin
(74) *Attorney, Agent, or Firm* — Miller, Matthias & Hull

(57) ABSTRACT

A rock claw is provided for a demolition hammer. The rock claw may be a separate component attachable to the external surface of the hammer housing. The rock claw may include a first portion with a first distal end and a first proximal end and a second portion with a second distal end and a second proximal end. The first proximal end is joined to the second proximal end to form an elbow and the second distal end having a first leg spaced apart from a second leg.

14 Claims, 4 Drawing Sheets

ROCK CLAW FOR DEMOLITION HAMMER

TECHNICAL FIELD

This disclosure relates generally to demolition hammers, and more specifically to rock claws for demolition hammers.

BACKGROUND

Demolition hammers are used on work sites to break up hard objects such as rocks, concrete, asphalt, frozen ground, or other materials. The hammers may be mounted to machines, such as back hoes and excavators, or may be hand-held. Such hammers may include a pneumatically or hydraulically actuated power cell having an impact system operatively coupled to a tool that extends from the hammer to engage the hard object. The impact system generates repeated, longitudinally directed forces against a proximal end of the tool. The distal end of the tool, extending outside of the housing, may be positioned against the hard object to break it up.

During operation, the hard objects may need to be rearranged or reoriented to better position them for breaking by the hammer. Hammer manufacturers discourage operators from using the tool to rearrange or reorient the hard objects because excessive side forces on the tool may damage the tool, seals, bushings, or other hammer components. As a result, hammer manufacturers may include rock claws on the hammer that are used to push against the hard objects while protecting the hammer housing and tool.

Rock claws are areas on the bottom portion of a hammer that are built-up to absorb the abrasion and wear from frequent pushing and scraping against hard objects. Most manufacturers provide a rock claw by extending an end plate of the hammer out beyond the profile of the housing. The cantilevered portion of the end plate is typically reinforced with other plates and gussets for strength.

After extended use, the end plate must be replaced due to wear on the rock claw portion. Since, however, the end plate is structurally a part of the functioning hammer (i.e. the end plate helps support other portions of hammer housing and power cell), replacing the end plate requires additional care, such as, for example, holding the housing structure square while the end plate is replaced.

SUMMARY OF THE DISCLOSURE

According to certain aspects of this disclosure, a demolition hammer may include a housing having a distal end defining an opening, a power cell positioned within the housing, a tool disposed in the power cell and projecting from the housing through the opening, and a first rock claw attached to an external side surface of the distal end of the housing.

In another aspect of the disclosure, a demolition hammer may include a first rock claw attached to an external side surface of the distal end of the housing and a second rock claw attached to an external side surface of the distal end of the housing opposite the first rock claw. The first rock claw may include a first portion attached to the external side surface of the distal end of the housing and a second portion extending along a bottom of the housing. The second rock claw may include a first portion attached to the external side surface of the distal end of the housing opposite the first rock claw and a second portion extending along a bottom of the housing toward the second portion of the first rock claw.

In a further aspect of the disclosure, a rock claw is provided for a demolition hammer, the rock claw having a first portion with a first distal end and a first proximal end and a second portion with a second distal end and a second proximal end. The first proximal end joining the second proximal end to form an elbow and the second distal end having a first leg spaced apart from a second leg.

In another aspect of the disclosure that may be combined with any of these aspects, the rock claw is configured as an attachable component to a fully functional demolition hammer.

In another aspect of the disclosure that may be combined with any of these aspects, the rock claw is may be removed from the demolition hammer without disassembling any portion of the hammer.

DETAILED DESCRIPTION

Figure 1:
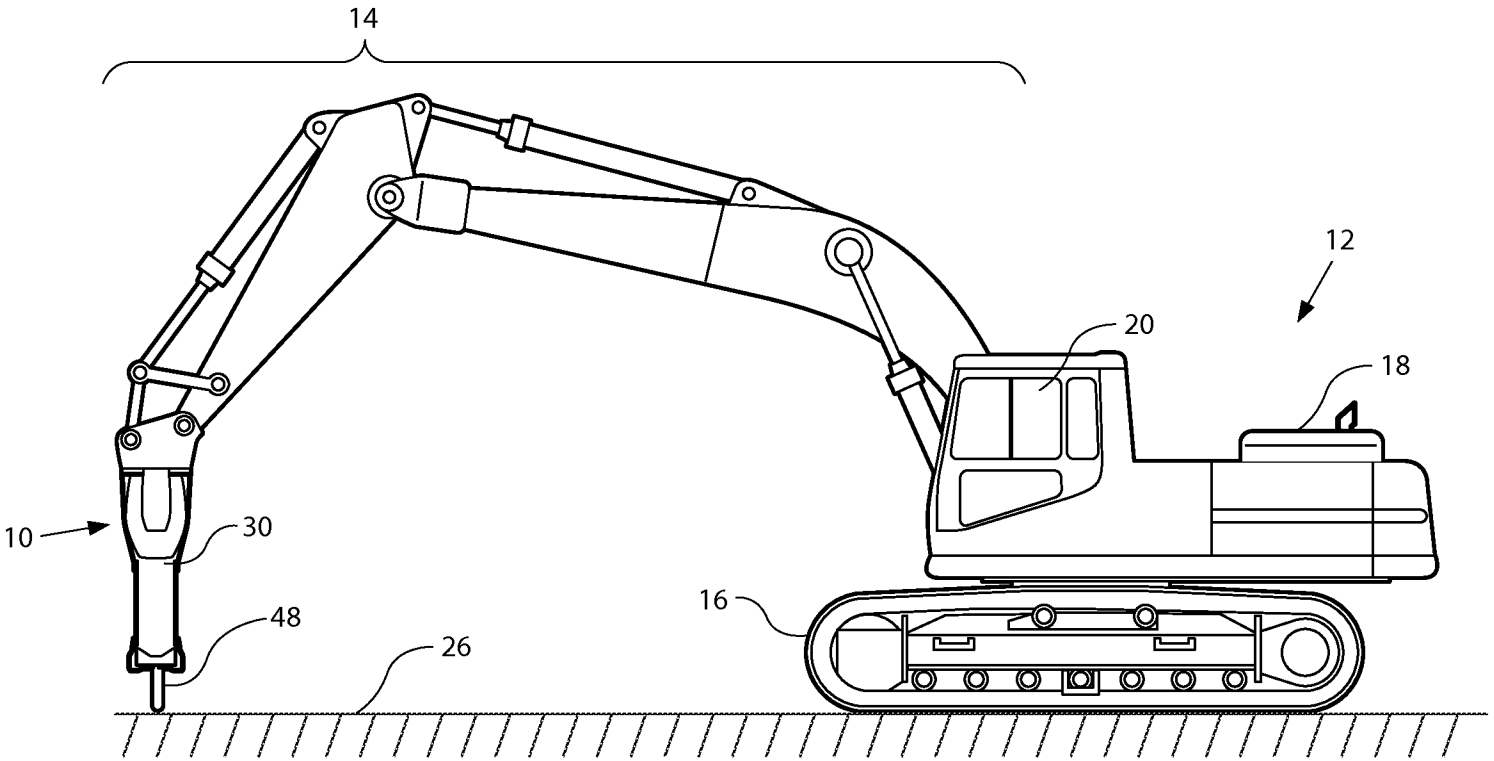
FIG. 1 is a diagrammatic illustration of a machine having a demolition hammer.

Referring to FIG. 1, a demolition hammer 10 is attached to a machine 12. Machine 12 may embody a fixed or mobile machine that performs some type of operation associated with an industry such as mining, construction, farming, transportation, or any other industry known in the art. For example, machine 12 may be an earth moving machine such as a backhoe, an excavator, a dozer, a loader, a motor grader, or any other earth moving machine. Machine 12 may include an implement system 14 configured to move the demolition hammer 10, a drive system 16 for propelling the machine 12, a power source 18 that provides power to implement system 14 and drive system 16, and an operator station 20 for operator control of implement system 14 and drive system 16.

Power source 18 may embody an engine such as, for example, a diesel engine, a gasoline engine, a gaseous fuel-powered engine or any other type of combustion engine known in the art. It is contemplated that power source 18 may alternatively embody a non-combustion source of power such as a fuel cell, a power storage device, or another source known in the art. Power source 18 may produce a mechanical or electrical power output that may then be converted to hydraulic pneumatic power for moving the implement system 14.

Implement system 14 may include a linkage structure acted on by fluid actuators to move the hammer 10. The linkage structure of implement system 14 may be complex, for example, including three or more degrees of freedom. The implement system 14 may carry the hammer 10 for breaking an object or ground surface 26.

The structure and operation of a demolition hammer are briefly described below. Demolition hammers are known in the art, and since it will be apparent to one skilled in the art that the rock claws disclosed may be used with a variety of demolition hammers, a detailed description of all the components and operation of a demolition hammer is not provided.

Figure 2:
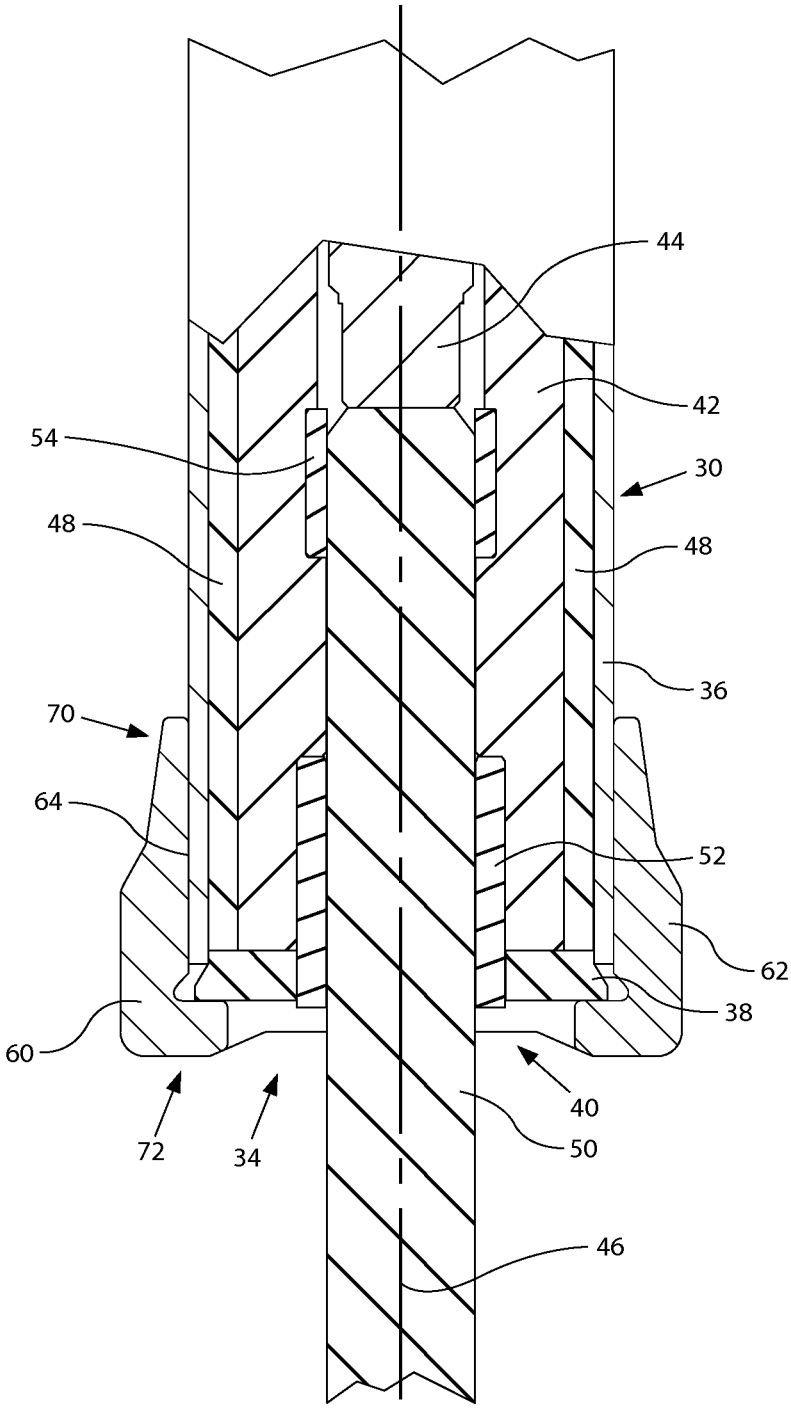
FIG. 2 is a partial cross-sectional view of the distal end of the hammer of FIG. 1 with rock claws attached.
Figure 3:
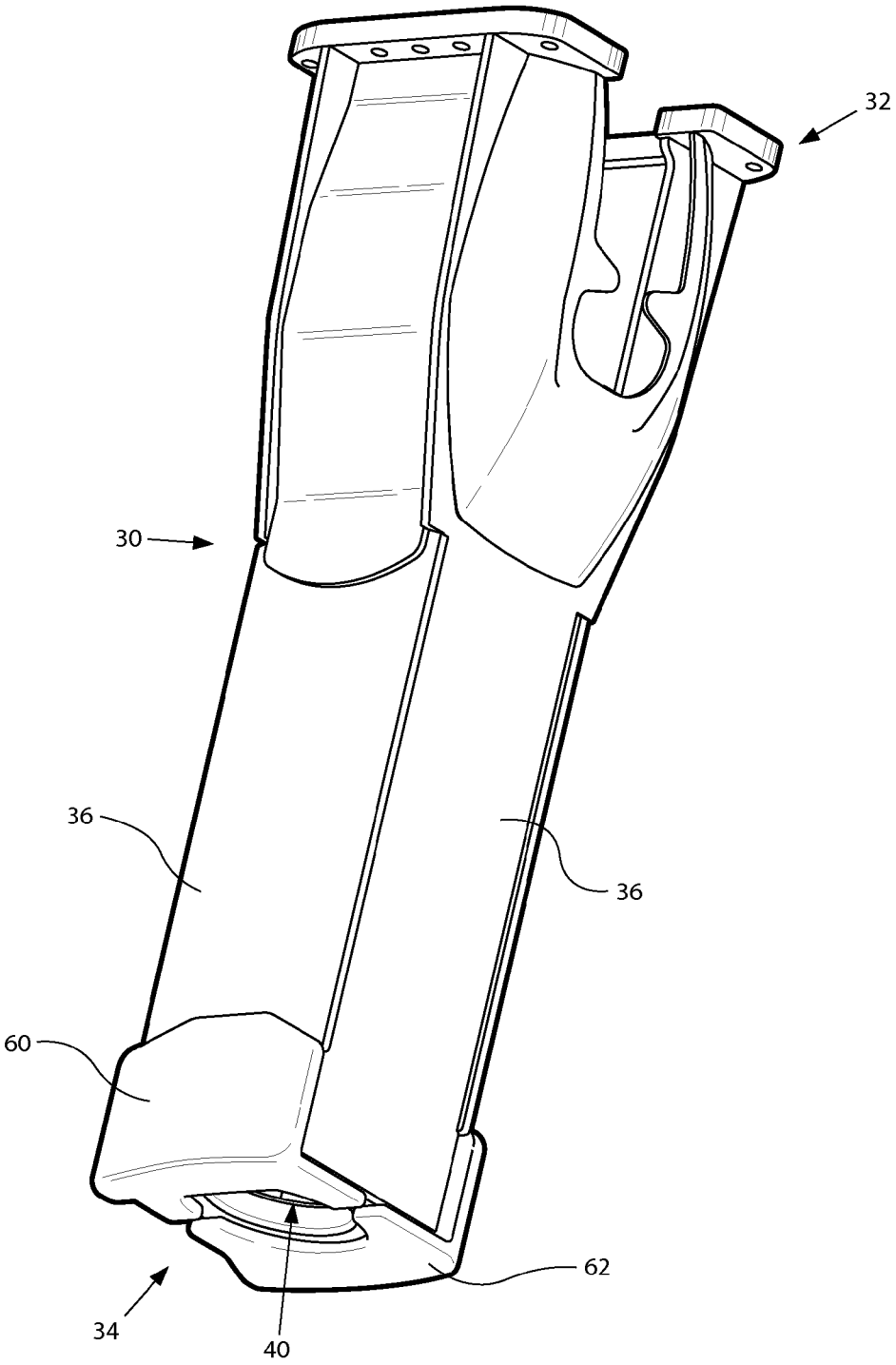
FIG. 3 is a perspective view of the housing of the hammer of FIG. 2.
Figure 4:
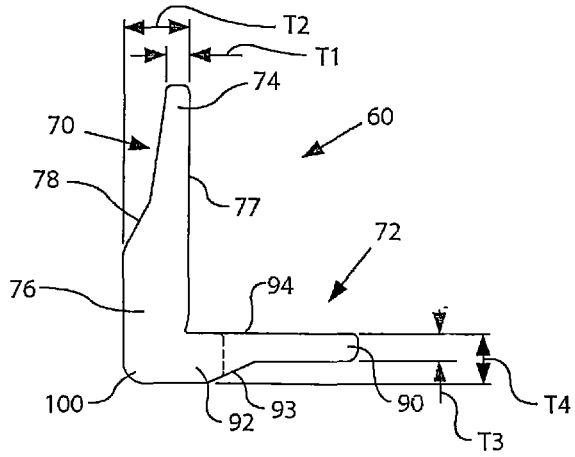
FIG. 4 is a side view of the rock claw of FIG. 3.

Referring to FIGS. 2 and 3, the hammer 10 includes a housing 30 having a proximal end 32 and a distal end 34. The housing 30 may be formed as a single piece or multiple portions that are welded or otherwise joined together. In the depicted embodiment, the distal end 34 of the housing 30 includes four, substantially parallel, side walls 36, although other configurations are possible. An end plate 38, defining an opening 40, is attached to the distal end 34 of the housing 30.

A power cell 42 is disposed inside the housing 30. The power cell 42 includes several internal components of the hammer 10. As shown in FIG. 2, the power cell 42 provides an impact assembly that includes a piston 44. The piston 44 is operatively positioned within the power cell 42 to move along an axis 46. Wear plates 48 are interposed between the power cell 42 and the housing side walls 36. A distal portion of the power cell 42 includes a tool 50 that is operatively positioned to move along the axis 46. A lower bushing 52 and an upper bushing 54 are positioned in the power cell 42 for guiding the tool 50 during operation of the hammer 10.

The hammer 10 may be powered by any suitable means, such as pneumatically-powered or hydraulically-powered. For example, a hydraulic or pneumatic circuit (not shown) may provide pressurized fluid to drive the piston 44 toward the tool 50 during a work stroke and to return the piston 44 during a return stroke. The hydraulic or pneumatic circuit is not described further, since it will be apparent to one skilled in the art that any suitable hydraulic or pneumatic systems may be used to provide pressurized fluid to the piston 44, such as the hydraulic arrangement described in U.S. Pat. No. 5,944,120.

In operation, near the end of the work stroke, the piston 44 strikes the tool 50. The distal end of the tool 50 may be positioned to engage an object or ground surface 26 (FIG. 1). The impact of the piston 44 on the tool 50 may cause a shock wave that fractures the hard object (e.g. rock) causing it to break apart.

The hammer 10 further includes a first rock claw 60 and a second rock claw 62. In some embodiments, the hammer 10 may include only a single rock claw. The first and second rock claws 60, 62 are separate components that are configured to be attached to and removed from a fully functional, assembled hammer. For example, in the depicted embodiment, the first rock claw 60 is attached to an external surface 64 of one of the side walls 36 at the distal end 34 of the housing 30. The second rock claw 62 is attached to an external surface 64 of a side wall 36 on the opposite side of the hammer 10. The rock claws 60, 62 may be attached to external surfaces 64 by any suitable manner, such as welding, fasteners, or other suitable means. In the disclosed embodiment, the rock claws 60, 62 are attached by welding.

The rock claws 60, 62 may be formed from a variety of materials. Since the rock claws 60, 62 are exposed to abrasive wear from contact with hard objects, the rock claws may be formed from a suitable wear resistant metal, ceramic, composite, or other material. In the depicted embodiment, the rock claws 60, 62 are cast from a wear resistant steel alloy.

The first and second rock claws 60, 62 may be configured in a variety of ways. Any configuration that can be attached to the housing 30 and can be used to engage and move hard objects while adequately protecting the distal end 34 of the housing 30 and the tool 50 from damage during use may be used. In the depicted embodiment, the first and second rock claws 60, 62 may be substantially identical, though in other embodiments, the first rock claw 60 may be shaped differently than the second rock claw 62. Since the detailed description of the first rock claw 60 is equally applicable to the second rock claw 62, the second rock claw 62 is not described further in detail.

Referring to FIGS. 2-5, the first rock claw 60 includes a first portion 70 and a second portion 72. The first portion 70 may be configured in a variety of ways. Any configuration that suitably protects the sidewall 36 of the distal end 34 of the housing 30 from damage by hard objects may be used. In the depicted embodiment, the first portion 70 includes a first distal end 74, having a first thickness T1, connected to a first proximal end 76, having a second thickness T2, by a first tapered intermediate portion 78. The intersection of the first tapered intermediate portion 78 with the first distal end 74 and with the first proximal end 76 provides structure (e.g. an edge or corner) that can catch an edge on an object being manipulated (e.g. catch an edge of a boulder to help roll the boulder). The first portion 70 has a substantially planar inner surface 77 and first side edge 79 and a second side edge 80 (FIG. 6) that may be substantially parallel to the first side edge. In the depicted embodiment, the first distal end 74 includes a first angled edge 82 and a second angled edge 84 that connect a middle edge 86 with the first and second generally parallel side edges 79, 80.

Figure 5:
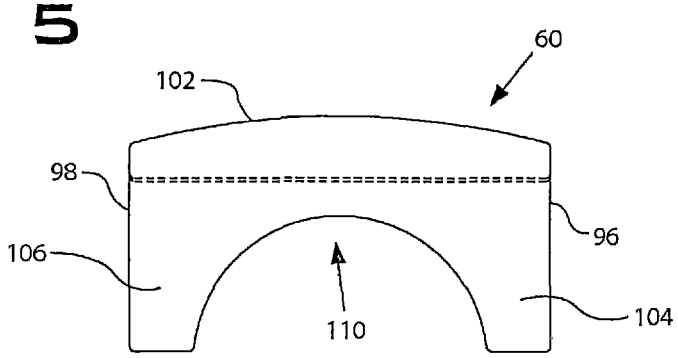
FIG. 5 is a bottom view of the rock claw of FIG. 3.
Figure 6:
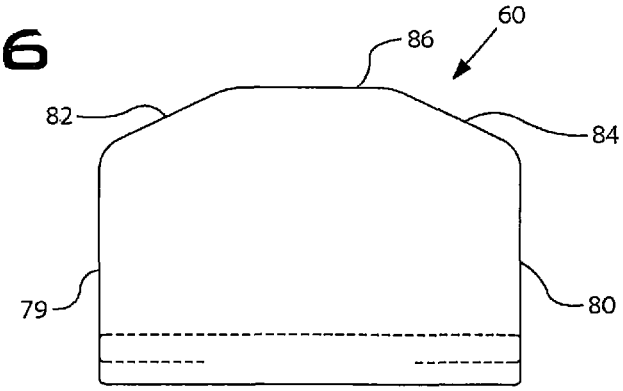
FIG. 6 is a front view of the rock claw of FIG. 3.

The second portion 72 may be configured in a variety of ways. Any configuration that suitably protects the bottom portion of the distal end 34 of the housing 30 and the end plate 38 from damage by hard objects may be used. The second portion 72 has a second distal end 90, having a third thickness T3, connected to a second proximal end 92, having a fourth thickness T4, by a second tapered intermediate portion 93. The second portion 72 has a substantially planar inner surface 94 and first side edge 96 and a second side edge 98 that may be substantially parallel to the first side edge (FIG. 5). The first proximal end 76 of the first portion 70 joins the second proximal end 92 of the second portion 72 to form an elbow 100.

In the depicted embodiment, the elbow 100 is approximately a 90 degree angle, which allows the inner surfaces 77, 94 of the first rock claw 60 to generally conform to the distal end 34 of the depicted housing 30. In other embodiments, the first portion 70 and the second portion 72 may be joined at an angle greater than or less than 90 degrees. In addition, in some embodiments, the inner surfaces 77, 94 of the first rock claw 60 may not substantially conform to the exterior of hammer housing 30.

As shown in FIG. 5, the elbow 100 has a curved outer edge 102. In other words, the elbow 100 is thicker in the middle of the first rock claw 60 than toward the side edges 96, 98 of the rock claw. In other embodiments, the middle and the edges may have similar thickness.

The second portion 72 includes first leg 104 spaced apart from a second leg 106 by a semicircular recess 110. The recess 110 is configured such that the second portion 72 protects the distal end 34 of the housing 30 and the end plate 38, but does not interfere with the tool 50 or overlap the opening 40. In other embodiments, the recess 110 may be shaped other than semicircular.

In the depicted embodiment, the first leg 104 and the second leg 106 are approximately the same length and extend approximately halfway across the end plate 38. In this manner, when both the first rock claw 60 and the second rock claw 62 are attached on opposite sides of the housing 30, the legs of each of the first and second rock claws 60, 62 extend toward each other and protect the bottom portion of the distal end 34 of the housing 30 and the end plate 38.

In the depicted embodiment, first proximal end 76 is thicker than the first distal end 74 and the second proximal end 92 is thicker than the second distal end 90. In other words, the first rock claw 60 is thicker in the region of the elbow 100 than on the distal ends 74, 90 since the elbow 100 will receive more contact with hard objects, and thus, more abrasive wear. Similarly, in the depicted embodiment, the first proximal end 76 is thicker than the second proximal end 92 since the first proximal end will receive more contact with hard objects. In other embodiments, however, the distal ends 74, 90 may have a similar thickness to the region of the elbow 100 and the first proximal end 76 may be a similar thickness as the second proximal end 92.

As indicated above, the first rock claw 60 and the second rock claw 62 may be substantially identical. Thus, the rock claws can be installed on either side of the hammer and can be utilized interchangeably.

Industrial Applicability

The rock claws provide protection to the distal end of the hammer such that an operator can use the rock claws to manipulate hard objects, such as boulders, to better position the objects for breaking.

The disclosed rock claws can be attached to a fully functional, assembled hammer by any sustainable means, such as welding. For example, a rock claw can be positioned against the exterior surface of the hammer housing and welded into place, such as along the side edges of the rock claw. The rock claws include a first portion that extends up the side of the housing to protect the housing side surface and also include a second portion that extends along the bottom of the housing to protect the bottom portion of the distal end of the housing and the end plate. A recess allows the rock claw to protect the distal end of the hammer without obstructing the tool that extends from the hammer.

Since the rock claw is a component separate from and attachable to the hammer, when the rock claw needs replacing, it can be cut from the exterior surface and replaced without disassembling the hammer.

Although the disclosed embodiments have been described with reference to a hammer assembly in which the tool is driven by a hydraulically or pneumatically actuated piston, the disclosed embodiments are applicable to any tool assembly having a reciprocating work tool movable within a chamber by suitable drive structure and/or return structure.

What is claimed is:

1. A rock claw comprising:

a first portion having a first distal end and a first proximal end;

a second portion having a second distal end and a second proximal end, the first proximal end joining the second proximal end to form an elbow, the second distal end comprising a first leg spaced apart from a second leg, wherein the first proximal end is thicker than the first distal end and the second proximal end is thicker than the second distal end.

2. The rock claw according to claim 1 wherein the first leg is separated from the second leg by a semicircular recess.

3. The rock claw according to claim 1 wherein the second portion extends at approximately a right angle to the first portion.

4. The rock claw according to claim 3 wherein the first portion includes a first planar inner surface and the second portion includes a second planar inner surface generally perpendicular to the first planar inner surface.

5. The rock claw according to claim 1 wherein the first and second proximal ends are thicker than the first and second distal ends.

6. The rock claw according to claim 1 wherein the first portion is formed integrally with the second portion.

7. The rock claw according to claim 1 wherein the first proximal end is connected to the first distal end by a tapered intermediate portion.

8. A demolition hammer comprising:

a housing having a distal end defining an opening;

a power cell positioned within the housing;

a tool disposed in the power cell and projecting from the housing through the opening; and a first rock claw attached to an external side surface of the distal end of the housing, the first rock claw comprising:

a first portion having a first distal end and a first proximal end;

a second portion having a second distal end and a second proximal end, the first proximal end joining the second proximal end to form an elbow, the second distal end comprising a first leg spaced apart from a second leg, wherein the first proximal end is thicker than the first distal end and the second proximal end is thicker than the second distal end.

9. The demolition hammer according to claim 8 wherein the first portion and second portion form an L-shape.

10. The demolition hammer according to claim 8 wherein the first leg is separated from the second leg by a semicircular recess.

11. The demolition hammer according to claim 8 wherein the first proximal end is connected to the first distal end by a tapered intermediate portion.

12. The demolition hammer according to claim 8 further comprising a second rock claw attached to an external side surface of the distal end of the housing opposite the first rock claw.

13. The demolition hammer according to claim 12 wherein the first portion of the first rock claw is attached to the external side surface of the distal end of the housing and the second portion extends along a bottom of the housing; and wherein the second rock claw includes a first portion attached to the external side surface of the distal end of the housing opposite the first rock claw and a second portion extending along the bottom of the housing toward the second portion of the first rock claw.

14. The demolition hammer according to claim 13 wherein the second rock claw is interchangeable with the first rock claw.

* * * * *